United States Patent [19]

Armitage

[11] Patent Number: 4,680,901

[45] Date of Patent: Jul. 21, 1987

[54] PRECAST CONCRETE DOME SYSTEM

[75] Inventor: J. Herbert Armitage, Calgary, Canada

[73] Assignee: Genstar Structures Limited, Calgary, Canada

[21] Appl. No.: 795,247

[22] Filed: Nov. 5, 1985

[51] Int. Cl.[4] ..... E04B 1/32

[52] U.S. Cl. ..... 52/81

[58] Field of Search ..... 52/82, 88, 86, 80, 81, 52/21, 169.9

[56] References Cited

U.S. PATENT DOCUMENTS

| | | | |
|---|---|---|---|
| 1,189,694 | 7/1916 | Janssen | 52/81 |
| 1,576,813 | 3/1926 | Davies | 52/81 |
| 1,891,763 | 12/1932 | Henderson | 52/320 |
| 2,059,477 | 11/1936 | Nelson | 52/89 |
| 2,365,145 | 12/1944 | Neff . | |
| 2,820,990 | 1/1958 | Johnson . | |
| 2,897,668 | 8/1959 | Graham | 52/81 |
| 2,944,370 | 7/1960 | Malarkey | 52/81 |
| 3,085,366 | 4/1963 | Jamison . | |
| 3,094,812 | 6/1963 | Peeler . | |
| 3,137,253 | 6/1964 | Clayton . | |
| 3,164,111 | 1/1965 | Lanni | 52/80 |
| 3,171,370 | 3/1965 | Fay . | |
| 3,172,392 | 3/1965 | Schultz | 52/80 |
| 3,180,057 | 4/1965 | Pritzker . | |
| 3,184,892 | 5/1965 | Silberkuhl et al. . | |
| 3,221,451 | 12/1965 | Stolz . | |
| 3,296,754 | 1/1967 | Silberkuhl et al. . | |
| 3,298,433 | 1/1967 | Lemelson | 52/309.12 |
| 3,300,916 | 1/1967 | Pritzker | 52/81 |
| 3,427,777 | 2/1969 | Crowley | 52/80 |
| 3,492,196 | 1/1970 | Moore | 52/309.12 |
| 3,744,205 | 7/1973 | Moss . | |
| 3,763,608 | 10/1973 | Chamlee . | |
| 3,768,218 | 10/1973 | Blaski . | |
| 3,788,015 | 1/1974 | Musser . | |
| 3,820,292 | 6/1974 | Fitzpatrick . | |
| 3,875,709 | 4/1975 | Hall . | |
| 3,919,813 | 11/1975 | Beindorf . | |
| 3,921,555 | 11/1975 | Suzuki . | |
| 3,924,367 | 12/1975 | Stewart . | |
| 4,023,317 | 5/1977 | Bettger . | |
| 4,133,150 | 1/1979 | Yacoboni . | |

FOREIGN PATENT DOCUMENTS

| | | |
|---|---|---|
| 99742 | 5/1906 | Canada . |
| 700358 | 12/1964 | Canada . |
| 717697 | 9/1965 | Canada . |
| 741046 | 8/1966 | Canada . |
| 744895 | 10/1966 | Canada . |
| 774800 | 1/1968 | Canada . |
| 896836 | 4/1972 | Canada . |
| 972124 | 8/1975 | Canada . |
| 979171 | 12/1975 | Canada . |
| 1028115 | 3/1978 | Canada . |

OTHER PUBLICATIONS

Architectural Forum, Nov. 1953, vol. 99, No. 5, *Magazine of Building*, p. 148.

*Primary Examiner*—John E. Murtagh

*Attorney, Agent, or Firm*—Leonard Bloom

[57] ABSTRACT

A domed self-supporting frameless building structure includes a plurality of monolithic, precast, elongated, concrete panels arranged in abutting edge to edge relationship with one another such that the panels are under compressive loadings in both the longitudinal and lateral directions. The longitudinal edges of each of such panels coincide with imaginary lines of longitude of a spherical or sphere-like shape. A plurality of circumferential courses of such panels are provided with the panels of any one such course being in abutting end-to-end relation with the panels of the next adjacent course. A tension ring surrounds the lower extremity of such dome and the lowermost ends of the panels of the lowermost course are in abutting relation with the ring thereby to assist in securing the panels together in the abutting edge to edge relationship.

9 Claims, 13 Drawing Figures

PRECAST CONCRETE DOME SYSTEM

BACKGROUND OF THE INVENTION

This invention relates to improvements in domed building structures.

The prior art has provided numerous forms of roof structures. Passive self-supporting structures include the cast-in-place shell structures of Luigi Nervi, which structures require extensive and complex forms and staging thus giving rise to substantial construction costs. Other passive structures include the elegant but complex lattice-work geodesic domes and cupolas as designed by Buckminister Fuller, the well known American designer. Other domed structures have been formed of wood, sheet metal, fibre glass and the like. Most of these structures require additional frame supports or panel stiffeners and/or special means for attaching the panels together thus giving rise to high installation costs.

Active roof supports include flexible air pressure supported domes made from air impervious fabrics or from thin sheets of stainless steel. Such structures have and are being used in large buildings such as sports stadiums, hockey rinks and the like. The disadvantages include high installation/operating costs due to the need for energy consuming blower systems to maintain air pressure, air lock doors etc. as well as the ever present danger of structural collapse in the event the thin roof material is pierced or torn by a moving object and/or the blower systems or air locks fail. A collapse of this nature, especially when the roof is carrying a substantial snow load, can produce disasterous results.

SUMMARY OF THE INVENTION

It is an object of the invention to provide a domed, passive, self-supporting building structure which can be erected with a minimum of stagings and supports, and which building structure employs prefabricated structural units which are identical to one another. Because of the repetition of components, the costs of forms etc. are relatively low. Also because of the repetition of identical components, erection on site is facilitated, again leading to reduced overall costs. The teachings of the invention can be used in a wide range of sizes of building structures, from relatively small domes of e.g. 100 ft. diameter up to 600 ft. diameter or even more.

Accordingly, the present invention in one aspect provides a domed self-supporting frameless building structure comprising a plurality of monolithic, precast, elongated, concrete panels arranged in abutting edge to edge relationship with one another such that the panels are under compressive loadings in both the longitudinal and lateral directions, the longitudinal edges of each of such panels coinciding with imaginary lines of longitude of a spherical or sphere-like shape; there being a plurality of circumferential courses of such panels with the panels of any one such course being in abutting end-to-end relation with the panels of the next adjacent course, and a tension ring surrounding the lower extremity of such dome and the lowermost ends of the panels of a lowermost said course being in abutting relation with said ring thereby to assist in securing said panels together in said abutting edge to edge relationship. The longitudinal edges of said panels each have a step-like recess therein such that in their edge-to-edge relationship, an elongated U-shaped recess is defined therebetween, which recess contains a grouting compound to fill the joints between the panels. Furthermore, the ends of the panels which abut with the panels of adjacent courses are provided with recesses therein forming lapped joints such that during erection, the end of each panel of a succeeding course may be supported from the end of a respective panel of a preceding course.

Further aspects of the invention will become apparent from the following description of a preferred embodiment of same taken in conjunction with the appended claims.

BRIEF DESCRIPTION OF THE DRAWINGS

In drawings which illustrate an embodiment of the invention.

DETAILED DESCRIPTION OF PREFERRED EMBODIMENT

Figures 1, 2, 3, 4, 5:
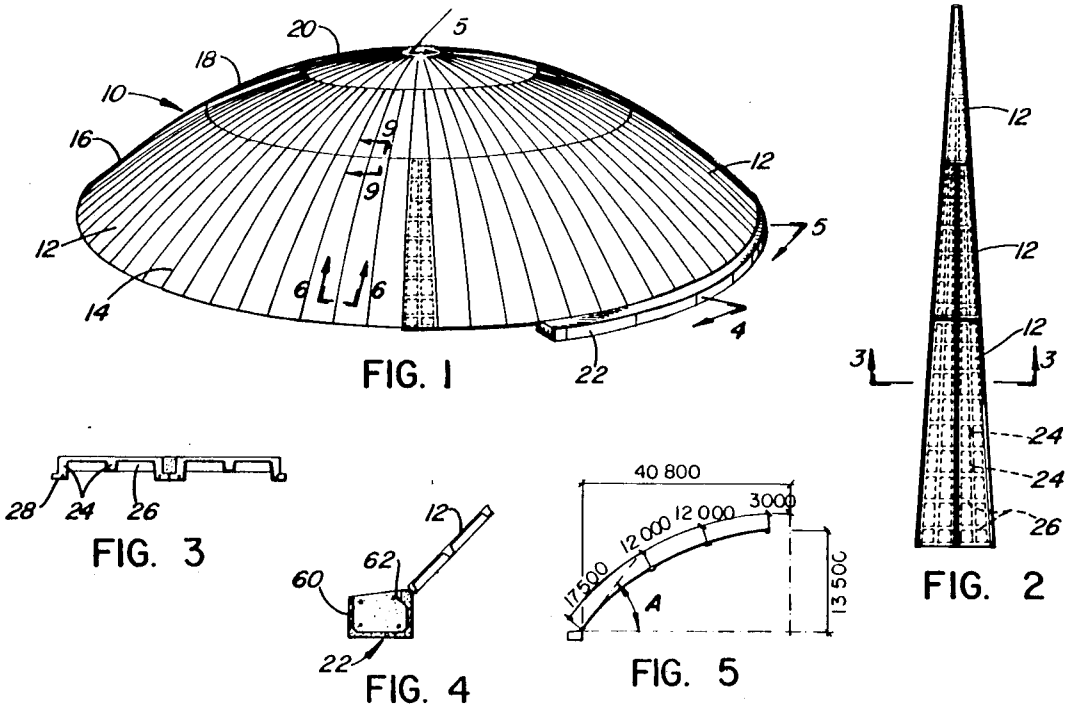
FIG. 1 is a perspective view of a domed structure according to the present invention.
FIG. 2 is a plan view of a group of dome segments as they would appear if laid out flat.
FIG. 3 is a section view taken along line 3—3 of FIG. 2 showing the panel structure.
FIG. 4 is a section view taken along line 4—4 of FIG. 1 and showing the tension ring.
FIG. 5 is a section view taken along line 5—5 of FIG. 1.

Referring now to the drawings there is shown at FIG. 1 a semi-spherical dome 10 incorporating the principles of the invention. The dome is self-supporting i.e. frameless. The dome 10 is essentially made up of a series of monolithic concrete panels 12 arranged in abutting edge-to-edge relation to one another with the panels 12 being under compressive loadings in both the longitudinal and transverse directions. The longitudinal edges 14 of the panels coincide with imaginary lines of longitude of the semi-spherical shape. In this example, there are shown three circumferential courses of panels i.e. a bottom course 16, an intermediate course 18 and a top course 20. The panels of each course 16, 18, 20 are in abutting end-to-end relation with the panels of the next adjacent course, such panel courses meeting along circumferential lines of latitude of the semi-spherical shape. A tension ring 22 circumscribes the lower extremity of the dome and the lower ends of the panels of the bottom course are in abutting relation therewith. Ring 22 thus reacts against the downward and outward thrusts imposed by the panels 12 and hence serves to maintain the panels 12 in their respective positions.

As seen from FIGS. 1 and 2 only three different panel sizes are required in this example, the panel size decreasing as one goes from the botton course 16, to the intermediate course 18 and thence to the top course 20. In the embodiment shown the panels 12 are single curved, i.e. curved along their lengths, to match the dome's spherical surface but flat in the lateral direction. However it will be understood that the panels 12 can be double curved, i.e. curved in the lateral direction as well, to better conform to the spherical surface defined by the dome as a whole, if required.

Each panel is provided with a waffle-like pattern on its lower surface which defines a series of longitudinal ribs 24 and a series of transverse ribs 26. The ribs provide extra strength and rigidity, these being supplemented by means of reinforcing rods or prestressed strand 28 embedded in the longitudinal ribs 24, such reinforcing 28 preferably being tensioned to provide a pre-stressed final product. The panels may also incorporate a wire mesh reinforcing grid (not shown) which extends throughout the entire extent of the upper layer of the panel. The total panel depth, measured at the marginal ribs 24, depends on the total panel span. Panel thickness, including stiffening ribs, may be from about 1.0 to 2 feet for total panel length of 16 to about 70 feet respectively. Panel thickness between the ribs is preferably from 1.5 to 2 inches. The concrete used may be the standard 150 lb./cu. ft. variety or the light weight 120 lb/cu. ft. variety. The panel width is determined by weight considerations i.e. truck and/or crane capacity. Suggested maximum width is presently 10 to 12 feet.

By using prestressed reinforcing the panels 14 can be made relatively long thus reducing the number of panel courses and reducing scaffolding and erection time. It should be noted that in the completed structure the dome essentially acts as a "thin shell" with the panels 12 in compression so that the panel reinforcing is not used to any extent i.e. it is essentially redundant except for buckling and eccentric loading conditions. However it increases the safety factor of the dome and enables point loads and snow loads to be withstood without panel failure.

Figure 6:
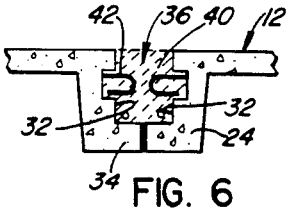
FIG. 6 is a section view taken along line 6—6 of FIG. 1 and showing the joint between panels.

With reference to FIGS. 3 and 6 it will be seen that the longitudinal edges of panels 12 are provided with a step-like recess 32 therein and running the full length of same. When the outer extremities 34 of ribs 24 contact each other in abutting relation, the recesses 32 together define a U-shaped-in-section recess 36 which receives a grouting compound 40 which completely fills the recess. Hairpin or U-shaped reinforcing bar portions 42 extending outwardly of the panel edges at spaced intervals are secured in the grouting compound 40 and serve to secure the panels 12 together.

Figure 7:
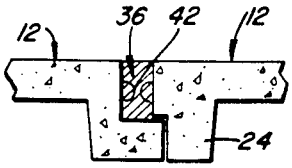
FIG. 7 is a section view taken along line 6—6 of FIG. 1 and show an alternative form of joint.

An alternative form of joint between the longitudinal edges of panels 12 is shown in FIG. 7. Each panel again includes a step-like recesss extending therealong except that here such stepped portions fit together in a ship-lap configuration so that one panel, at least temporarily during construction, supports the other. (This would permit erection of panels without scaffolding after initial ring beam panel erection is complete.) Again, a U-shaped recess 36 is provided which is filled with grouting compound 40, the latter engaging the reinforcing bar portions 42 as before.

Figure 9:
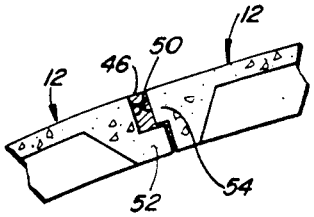
FIG. 9 is a section view taken along line 9—9 of FIG. 1 showing the joint between adjacent panel ends.

The joint configuration at the abutting ends of adjacent panels (FIG. 9) is similar to that of FIG. 7. A U-shaped recess 46 is defined between them which is filled with grouting 48, with reinforcing bar loop portions 50 engaging in the grouting 48 and helping to secure the panels together. The step-like portions 52, 54 fit together in ship-lap fashion with the end of lower panel 12 supporting the end of the next upper panel 12. This feature is of importance during erection procedures as it reduces the amount of scaffolding needed.

Figure 8:
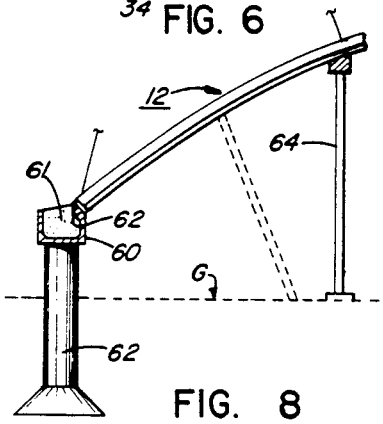
FIG. 8 is a somewhat simplified view illustrating the erection procedure.

Referring to the tension ring 22 (FIGS. 4 & 8) there is shown a pre-cast segmental trough 60. The trough sections are set in place, such as on the upper ends of concrete columns or piles 62 which may extend above ground level G a desired distance. The reinforcing bars are then put in place within the trough and suitably lapped. (Such reinforcing may be in the form of post-tensioning if desired whereby to keep the ring 22 in compression). The segmental trough 60 is filled with concrete 61, which surrounds the reinforcing.

After the tension ring 22 has been completed, erection of panels 12 can take place. A suitable crane or hoist (not shown), lifts the individual panels up and lowers them down so that the lower ends of same abut against the sloping annular seat portion 62 defined on ring 22 while the upper ends of the panels rest on ring scaffold 64 or tilt post supports. After all panels of the bottom course have been put into place, the longitudinal joints (FIGS. 6 or 7) are grouted and allowed to cure. Following this the next course of panels is laid in place using essentially the same procedure, and so on, until the uppermost course of panels has been properly positioned and the joint grouting cured following which the interior scaffolding may be removed, at which point the entire dome structure behaves as a "thin shell" i.e. with all the panels 12 in compression. In other words, the panels 12 are in edge to edge compressive force transmitting, mutually interdependent supporting relationship with one another.

With reference to FIG. 5 there is shown a typical example of a structure. The length of the first panel course is 17.5 meters while that of the next two courses is 12.0 meters each. The diameter of the central top opening is 6.0 meters and the overall height of the dome structure is 15.3 meters. The radial distance from the central axis of the structure to the perimeter is 40.80 meters. These dimensions are illustrative only and not limiting as the invention permits a wide variety of building sizes to be constructed.

With further references to FIG. 5, the spring angle A should be kept between about 40° and 52°. When the angle is less than 40° the buckling forces on the panels increase substantially as does the tension in ring 22. At angles greater than 52° the headroom becomes excessive thus leading to a less economical design.

In order to further reinforce the dome structure, reinforcing bars or strand could be placed in the longitudinal joints between the panels 12 before grouting to increase the safety factor. Also, circumferential strands or reinforcing bars could be placed in the joints between the adjacent ends of the panels before grouting for the same reason.

Figure 10:
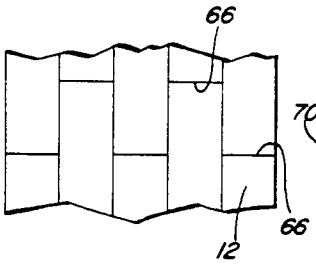
FIG. 10 is a fragmentary view of the dome surface showing an alternative arrangement wherein the joints between adjacent panel ends are staggered.

A modification of the structure is shown in FIG. 10. Here the joints 66 between adjacent panel ends are staggered. This has the advantage that the panels 12 of the first course serve as a guide in the placement of the panels 12 of the next course (and can support them when proper ship-lap edges are provided. This would eliminate some interior scaffolding).

Figure 11:
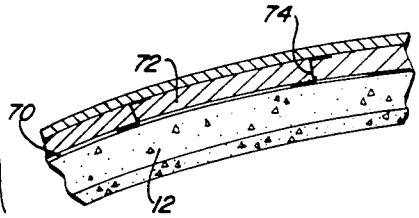
FIG. 11 is a longitudinal section view of one of the panels showing insulation and roofing in combination therewith.

FIG. 11 illustrates the roofing technique. After the panels 12 have been all laid in place, a layer 70 of mastic material is supplied to the dome surface to provide a vapor barrier and air seal. Following this, sheets of rigid foam insulation 72 are laid on the surface and held in place with clips 74. A top weather resistant membrane 76 such as SARNAFIL is then applied in known fashion to complete the roofing procedure.

Figure 12:
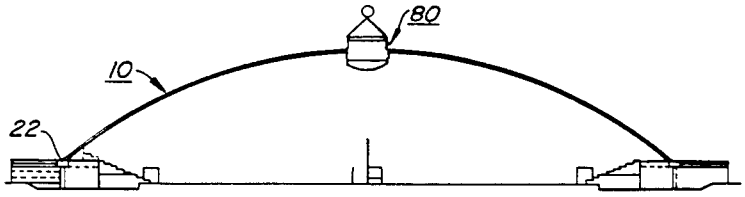
FIG. 12 is a vertical section through a hockey arena incorporating the invention.
Figure 13:
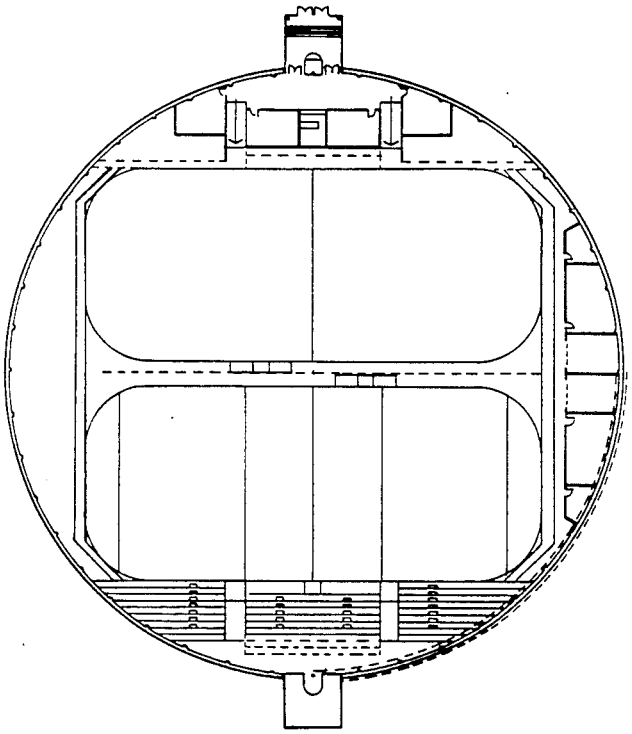
FIG. 13 is a plan view of the arena of FIG. 12 but with the roof removed.

Completed building structures are shown in FIGS. 12 and 13. As seen in FIG. 12 the dome 10 is provided with a top vent housing 80 which could contain mechanical equipment e.g. a venting fan (not shown). The building structure is shown as housing side-by-side ice hockey rinks together with bleachers and the other amenities usually associated with hockey rinks. Many other uses for the building are contemplated such as field houses, soccer facilities, football, curling rinks, tennis, basketball or volleyball courts, arenas for cattle shows and auctions, circus performances, stage shows and the like.

The building structure described has many advantages over other types of domed structures. The structure described provides a passive, long span roof (without need of interior columns) using concrete in its most efficient mode of use - under compression, with all its inherent properties including durability, fire resistance and low maintenance. Because of the repetition of the components, (each course of panels having all identical units), forming costs are relatively low thus lowering the overall building cost. The interior waffling on the panel allows substantial strength with low weight and such waffled structure additionally provides acoustic (sound absorbing) benefits as well. The exterior insulation provides for a "warm" support structure which does not require thermal expansion joints and the like and a valuable heat or cold "sink". The same basic design can be used to provide a wide range of sizes of buildings. The precast concrete components can be plant produced locally using local materials and services. Erection techniques are very simple and rapid erection is made possible. Minimum on-site construction time should permit dome erection to be completed in only three or four weeks of time.

I claim:

1. A domed self-supporting frameless building structure comprising a plurality of monolithic precast, elongated, concrete panels arranged in marginal edge-to-edge compressive force transmitting mutually interdependent supporting relationship with one another such that said panels are under compressive loadings along their marginal edges in both the longitudinal and lateral directions, the longitudinal edges of each of said panels coinciding with imaginary lines of longitude of a spherical or sphere-like shape; there being a plurality of circumferential courses of said panels with the panels of each said course being in end-to-end compressive force transmitting relation with the panels of the next adjacent course, a tension ring surrounding the lower extremity of the lowermost course of said panels and the lowermost ends of the panels of said lowermost course being in abutting force transmitting relation with said ring thereby to assist in securing all of said panels together in said marginal edge to edge compressive force transmitting relationship so that the domed structure behaves as a thin shell with all of said panels being under said compressive loadings and wherein the longitudinal edges of said panels have elongated step-like recesses therein such that, in their edge-to-edge relation, an elongated U-shaped recess is defined at the joint between each adjacent pair of said panels, each said recess containing a grouting compound to fill the joints between said panels, and the ends of said panels of each course which are in said end-to-end relation with the panels of the next adjacent course having recesses therein forming lapped joints between said ends of said panels in adjacent courses such that during erection the end of each panel of a succeeding course may be supported from the end of an adjacent panel of the preceding course.

2. The structure of claim 1 wherein said precast panels include integral stiffening ribs on their undersides, and reinforcing means in said ribs to take up any tension loadings.

3. The structure of claim 2 wherein the thickness of said precast panels including said stiffening ribs is from about 1.0 to 2 ft and the total panel length is from about 16 to 70 feet respectively.

4. The structure of claim 1 wherein each of said panels is curved in the longitudinal direction to coincide with said spherical or sphere-like shape, each such panel being flat in the lateral direction.

5. The structure of claim 1 wherein each of said panels is curved in both the longitudinal and lateral directions to coincide with said spherical or sphere-like shape.

6. The structure of claim 1 wherein the domed building is of semi-spherical shape.

7. The structure of claim 1 wherein said tension ring comprises a segmented circular trough having reinforcing means extending therein, and the trough being filled with concrete and in engagement with said reinforcing means.

8. The structure of claim 1 wherein said domed structure includes an exterior layer of insulation covered by a weather resistant layer.

9. The structure of claim 1 wherein longitudinal reinforcing means extends within said elongated U-shaped recesses from the bottom to the top of the domed structure.

* * * * *